US005355630A

United States Patent [19]

Kocznar et al.

[11] Patent Number: 5,355,630

[45] Date of Patent: Oct. 18, 1994

[54] PROCEDURE FOR CONTROLLING A TURNSTILE AND A TURNSTILE CONTROLLED BY SAID PROCEDURE

[75] Inventors: Wolfram Kocznar, Innsbruck; Kurt Wallerstorfer, Irrsdorf, both of Austria

[73] Assignee: Skidata Computer Gesellschaft m.b.H., Gartenau

[21] Appl. No.: 30,201

[22] PCT Filed: Jul. 23, 1992

[86] PCT No.: PCT/AT92/00102

§ 371 Date: Mar. 24, 1993

§ 102(e) Date: Mar. 24, 1993

[87] PCT Pub. No.: WO93/03251

PCT Pub. Date: Feb. 18, 1993

[30] Foreign Application Priority Data

Aug. 9, 1991 [AT] Austria ..... 1578/91

[51] Int. Cl.[5] ..... E06B 3/00

[52] U.S. Cl. ..... 49/506; 49/32; 49/47

[58] Field of Search ..... 49/47 X, 46, 43, 506, 49/32 X

[56] References Cited

U.S. PATENT DOCUMENTS

| | | | |
|---|---|---|---|
| 3,364,620 | 1/1968 | Hess et al. | 49/32 X |
| 3,497,997 | 3/1970 | Sheckells | 49/32 X |
| 3,998,008 | 12/1976 | Collins | 49/47 |
| 4,020,927 | 5/1977 | Collins | 49/46 X |
| 4,142,620 | 3/1979 | Sheehan | 49/47 X |
| 4,581,849 | 4/1986 | Schwarz | 49/32 |

FOREIGN PATENT DOCUMENTS

| | | |
|---|---|---|
| 389736 | 1/1990 | Austria . |
| 0423016 | 4/1991 | European Pat. Off. . |
| 3831056 | 9/1989 | Fed. Rep. of Germany . |
| 9008875 | 8/1990 | PCT Int'l Appl. . |
| 2186618 | 8/1987 | United Kingdom . |

*Primary Examiner*—Philip C. Kannan
*Attorney, Agent, or Firm*—Lorusso & Loud

[57] ABSTRACT

A motor driven turnstile for providing cyclic access to a passage (16) to which a monitoring system or the like is allocated. The turnstile is controlled in such a way that, after a satisfactory monitoring result, each blocking arm (4) is first taken from the blocking position to a stopping position located at a small angle (alpha) from the blocking position, in which, after external pressure applied by the user, the arm is once again driven by the drive motor (6) and turned further until the next arm is in the blocking position.

5 Claims, 1 Drawing Sheet

PROCEDURE FOR CONTROLLING A TURNSTILE AND A TURNSTILE CONTROLLED BY SAID PROCEDURE

FIELD OF THE INVENTION

The present invention relates to a procedure for controlling a turnstile for the cyclical release of a walkway, with an associated control system or the like, said turnstile incorporating a plurality of blocking arms that are displaced at an angle relative to each other, each of which defines a blocking position, with a drive motor, and an angle of rotation identification system, and in which, after a positive result to monitoring, each blocking arm is first rotated by the application of an external force, and then by the drive motor, as well as to a turnstile that can be controlled by said procedure.

BACKGROUND OF THE INVENTION

A turnstile of this kind, which locks in the stop position, such as is described, for example, in WO-A-90/8875 is provided with a torsionally elastic coupling that permits a slight amount of rotation despite the fact that the blocking arms are locked, and is monitored by an angle of rotation identification system. In one embodiment, the locked stop position is held by an electric motor which, once the control system permits passage, is rotated further into the next stop position after the user pushes against the turnstile. In the event of illicit rotation the motor is not started but reinforced by a mechanical brake.

A turnstile that is similarly powered by a motor is described in DE-C-38 31 056; in this, the motor is started after an impulse that is provided by the user. A brake is triggered electrically so as to act counter to any illicit rotation.

A further turnstile with access control, in which the stop position is fixed by means of an electronically controlled brake, is described in GB A2 186 618. In the event that unimpeded passage is to be provided, slow and continuous operation by means of a motor can be effected.

In the case of monitored passageways that provide for controlled passage by turnstiles, on the one hand the behaviour or the customary actions of the users, and, on the other hand, specific safety criteria, have to be considered. A turnstile that is released as a result of positive monitoring may not be rotated immediately by a motor; rather, it must be rotated by the user as soon as he is ready to pass through it. In this case, the rotation of the turnstile that has been released is effected by the pressure of the user's body against the blocking arm, when the locking resistance must be overcome. Only the overcoming of this locking resistance indicates, on the one hand, readiness to pass through, and, on the other hand, the correct position of the user, so that the subsequent motorized movements takes place at the anticipated time. Overcoming the locking resistance can be problematic, not only for children, but also, in particular for adults at the access points to T-bar ski lifts, when it must not be forgotten that the following blocking arm swings into position behind the user.

SUMMARY OF THE INVENTION

It is the task of the present invention to create a procedure for controlling a turnstile and a turnstile that is controlled by said procedure, which better meets the demands imposed upon it. According to the present invention, this has been achieved in that when the results of monitoring are positive, each blocking arm is moved from the blocking position into a subsequent stop position and in that after the application of an external force it is rotated out of the stop position until the next blocking arm is in the lock position.

The introduction of a stop position that is located after the lock position ensures that if the results of monitoring are positive, the blocking arm is first moved into the stop position, when this movement is not only felt by the user, but is also visible to him. He can then adopt the correct position that makes passage possible without any problems and push against the blocking arm that is again stationary in the stop position, whereupon the blocking arm can be further rotated by means of the motor. However, in the stop position it is not necessary to overcome a great resistance in order to indicate readiness to pass through the turnstile because the user has only advanced as far as the stop position as a prerequisite for doing this. Now all that is required is a gentle touch on the blocking arm, which can be managed by users who are on skis, and on gently inclined ground, by small children as well as by adults, without any difficulty.

According to the present invention, a turnstile that can be controlled by this process is characterized in that the turnstile incorporates a stop position that lies at an angle after the blocking position; in this position, the drive motor is stopped until an external force is applied. Since it is intended that, in the blocking position, a higher resistance has to be overcome in order that the turnstile is, at least, very difficult to turn if it is not monitored or if the results of monitoring are negative, it preferably incorporates a brake, in particular an electromagnetic brake, which is activated in the blocking position. In particular, a DC motor is used to power this, and this can be short-circuited in the stop position.

A first embodiment, which provides for a favourable spatial arrangement of the turnstile, provides for the fact that a bevel gear train is incorporated between the bearing shaft for the rotating disk and the motor output shaft. This means that the angle of rotation recognition system can be associated with the pinion on the bearing shaft, on the side that is opposite to the motor output shaft, so that a more compact construction of the turntable becomes possible.

In addition, it is also preferred that the brake and a mechanical return stop that includes a direction of rotation recognition system and a device to stop illicit rotation be arranged on the motor output shaft. This makes it possible to arrange devices that are required in order to permit passage in only one direction, and to do so in a space-saving manner.

A second embodiment of the turnstile with an advantageous spatial arrangement of the individual parts provides for the fact that a chain drive is provided between the bearing shaft and the motor output shaft, the drive chain of this passing around cogs on the bearing shaft, on the motor output shaft, and on a brake shaft that is acted upon by the brake.

In this embodiment, in order to permit passage in only one direction, provision is made such that a direction of rotation identification system that activates the brake in the case of illicit rotation and the angle of rotation identification system are associated with the drive chain. The embodiment entails the added advantage that the direction of passage can be reversed, so that a turnstile of this kind can be used for both entries and exits by simply changing over the control system.

The present invention will be described in greater detail on the basis of the drawings appended hereto, without being confined to these. These drawings show the following:

DETAILED DESCRIPTION OF THE PREFERRED EMBODIMENT

Figure 1:
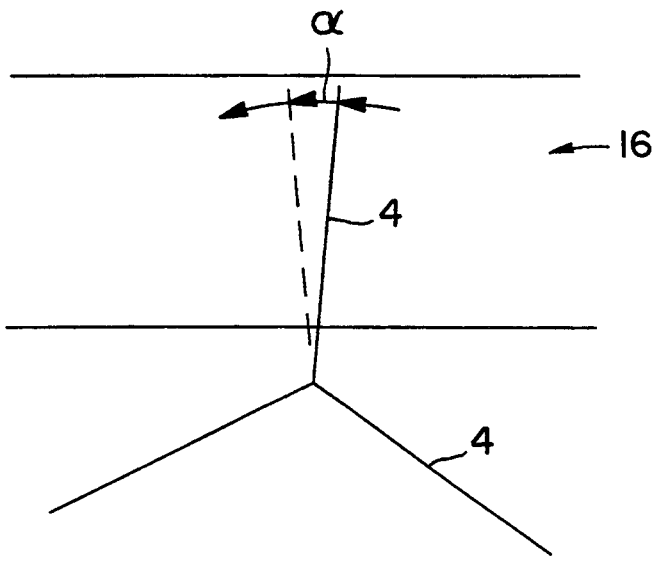
FIG. 1 is a schematic plan view of a turnstile.

A passageway 16 has a turnstile, the three blocking arms 4 of which are shown in FIG. 1. The blocking arm 4 that points upwards is located in a blocking position that is located at an angle $\alpha$ of approximately 10° ahead of a stop position that is indicated by a dashed line. The turnstile, which is driven by an electric motor 6, is halted in the blocking position of each blocking arm 4 by means of an electro-magnetic brake 8, the motor 6 being stationary during the movement of the brake 8. As soon as the control system that is associated with the turnstile permits passage along the walkway, the brake 8 is released and the motor 6 rotates the particular blocking arm 4 from the blocking position into the stop position, in which the motor 6 comes to a standstill, and, in particular, is short-circuited. At this time, the user must push against the blocking arm 4, whereupon the motor 6 is switched on once again. The brake 8 remains released in the stop position. The pressure that is to be exerted on the blocking arm 4 is very small, and for this reason can be generated without any problem even under unfavourable conditions. The motor 6, switched on once again, rotates the turnstile and permits passage, until such time as the next blocking arm 4 moves into the blocking position, in which the brake 8 is reactivated. Precise positioning of the blocking arm 4 in the blocking position and in the stop position is not of critical importance. Thus, the blocking position or the stop position can be perpendicular to the direction of passage. Of course, intermediate positions, as well as other values for the angle, are also possible.

The turnstile is provided in the customary Kay with a housing 1, within which a bearing shaft with a rotating disk 3 and the blocking arms 4 that extend from this are all arranged. It is preferred that the shaft 2 extend obliquely, and the blocking arms 4 do not extend radially from the rotary disk 3, so that the blocking arm 4 that is in the blocking position in each instance is almost horizontal. However, such details are not important to the present invention and can be adapted to the particular passage.

Figure 2:
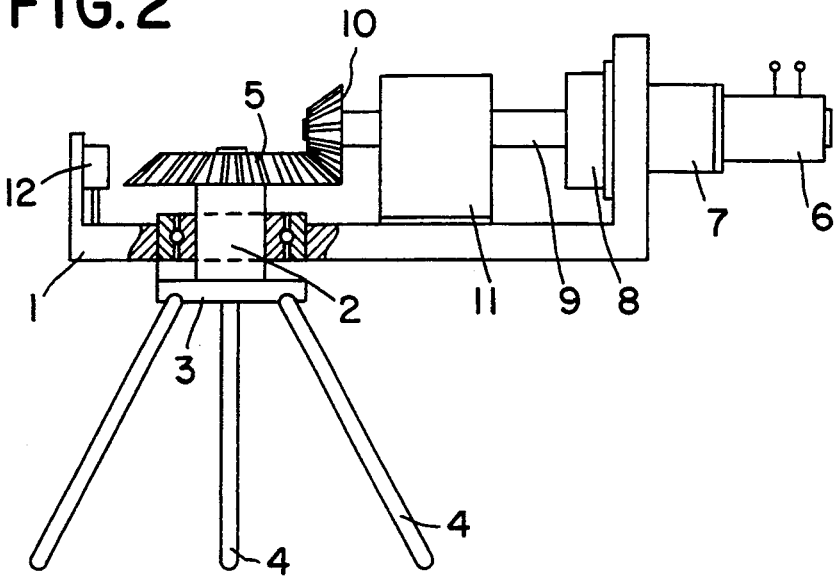
FIGS. 2 and 3 diagrammatic side views of two embodiments.

Between the bearing shaft 2 and the motor output shaft 9 there is a bevel gear train, as is shown in FIG. 2. The teeth of the pinion 5 on the bearing shaft 2 having an associated angle of rotation identification system 12 that determines the particular angle of rotation of 110° and 10°. The motor output shaft 9 supports the pinion 10 that engages with the pinion 5, a mechanical return lock 11 (not shown in greater detail herein), which ensures that rotation can only take place in one direction, and which prevents rotation in the illicit opposite direction, as well as the electro-magnetic brake 8, and is connected through a reducing gear 7 to the motor 6.

Figure 3:
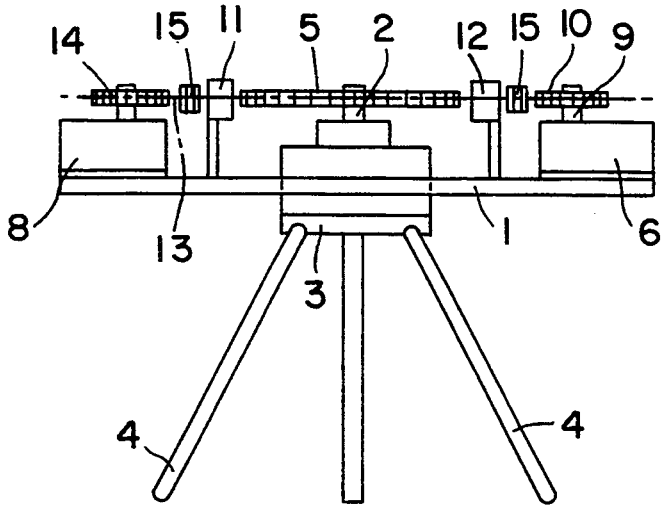

The configuration that is shown in FIG. 3 is a construction that is approximately symmetrical with respect to the bearing shaft 2, the motor 6 and, on the other hand, the brake 8, being arranged in the housing 1. Force is transmitted by way of a drive chain 13 that connects the pinion 10 on the motor output shaft 9, the pinion 5 on the bearing shaft 2, and a pinion 14 on a brake shaft, which can be secured by means of the electromagnetic brake 8. The three pinions 5, 10, and 14 are configured as chain wheels (cogs), and the chain 13 follows a path that is eliptical-oval. In the intermediate runs, on the one hand the angle of rotation identification system 12, which controls the motor 6 and the brake 8, and, on the other hand, a direction of rotation identification system 11, which controls the brake if the turnstile is rotated in a direction that is not permitted, are associated with the drive chain 13 in the intermediate runs. Chain tensioners are numbered 15. The embodiment that is shown in FIG. 3 can be used for both entrances and for exits, for both permitted and illicit directions of rotation, can be alternated very simply by switching over the controls.

In place of the electro-magnetic brake 8 and the electric drive motor 6 that have been described, it is possible to use, for example, hydraulically powered brakes and motors.

We claim:

1. A procedure for controlling a turnstile for the cyclical release of a passageway having a control system, the turnstile comprising a plurality of blocking arms that are offset at an angle to each other, thereby defining a blocking position, said turnstile further comprising a drive motor, and an angle of rotation identification system whereby each of said plurality of said blocking arms is first moved by an externally applied force and then rotated by said drive motor, such that each blocking arm is moved from the blocking position into a subsequent stop position and then, after application of an external force, rotated from the stop position until a next blocking arm is in the blocking position.

2. A turnstile that is controlled by means of the procedure described in claim 1, with blocking arms that are offset at an angle to each other and extend from a rotating disk, each of these blocking arms extending approximately perpendicular to the direction of passage when in the blocking position, with a drive motor, with an angle of rotation identification system, and with a monitoring system that, if the results of such monitoring are positive, causes the drive motor to rotate after the application of an external force to the blocking arm, characterized in that the turnstile has a stop position that is located at an angle ($\alpha$) after the blocking position, in which the drive motor is stopped until an external force is applied.

3. A turnstile as defined in claim 2, characterized in that a bevel gear train is incorporated between a bearing shaft of the rotating disk and the motor output shaft.

4. A turnstile as defined in claim 3, characterized in that the angle of rotation identification system is associated with a pinion of the bevel gear train on the side thereof opposite to the motor output shaft.

5. A turnstile as defined in claim 2, characterized in that a chain drive is incorporated between a bearing shaft of the rotating disk and the motor output shaft, the drive chain passing around pinions on the bearing shaft of the rotating disk, on the motor output shaft, and on a brake shaft that is acted upon by a brake.

* * * * *